US010557478B2

(12) United States Patent
Xu et al.

(10) Patent No.: US 10,557,478 B2
(45) Date of Patent: Feb. 11, 2020

(54) FAN ASSEMBLY FOR ROBOT VACUUM CLEANER AND ROBOT VACUUM CLEANER

(71) Applicants: JIANGSU MIDEA CLEANING APPLIANCES CO., LTD., Suzhou (CN); MIDEA GROUP CO., LTD., Foshan (CN)

(72) Inventors: Xiaowei Xu, Suzhou (CN); Fangfei Xiong, Suzhou (CN)

( * ) Notice: Subject to any disclaimer, the term of this patent is extended or adjusted under 35 U.S.C. 154(b) by 0 days.

(21) Appl. No.: 16/128,540

(22) Filed: Sep. 12, 2018

(65) Prior Publication Data

US 2019/0368507 A1 Dec. 5, 2019

Related U.S. Application Data

(63) Continuation of application No. PCT/CN2018/098020, filed on Aug. 1, 2018.

(30) Foreign Application Priority Data

May 30, 2018 (CN) ..... 2018 2 0837853 U

(51) Int. Cl.
*F04D 29/42* (2006.01)
*A47L 5/22* (2006.01)
(Continued)

(52) U.S. Cl.
CPC ..... *F04D 29/4226* (2013.01); *A47L 5/22* (2013.01); *A47L 9/22* (2013.01); *F04D 17/168* (2013.01); *A47L 2201/00* (2013.01)

(58) Field of Classification Search
CPC ..... F04D 17/00; F04D 17/08; F04D 17/168; F04D 25/06; F04D 25/0606; F04D 25/08;
(Continued)

(56) References Cited

U.S. PATENT DOCUMENTS 5,296,769 A * 3/1994 Havens ..... A47L 5/22 310/58
7,013,528 B2 * 3/2006 Parker ..... A47L 5/28 15/364
(Continued)

FOREIGN PATENT DOCUMENTS

CN 106481588 A 3/2017
CN 206723092 U 12/2017
(Continued)

*Primary Examiner* — Dwayne J White
*Assistant Examiner* — Danielle M. Christensen
(74) *Attorney, Agent, or Firm* — Kilpatrick Townsend & Stockton, LLP

(57) ABSTRACT

A fan assembly for a robot vacuum cleaner and a robot vacuum cleaner are provided. The fan assembly includes an electric motor, a stator impeller, a rotor impeller and a fan cover. The stator impeller defines a shaft hole, the electric motor is mounted on a side of the stator impeller, and an output shaft of the electric motor passes through the shaft hole. The fan cover is mounted on another side of the stator impeller, and an end surface of the fan cover away from the stator impeller defines an air inlet. The rotor impeller is mounted to the output shaft of the electric motor and located between the fan cover and the stator impeller.

14 Claims, 3 Drawing Sheets

(51) Int. Cl.
*A47L 9/22* (2006.01)
*F04D 17/16* (2006.01)

(58) Field of Classification Search
CPC .... F04D 29/002; F04D 29/04; F04D 29/0405; F04D 29/05; F04D 29/053; F04D 29/054; F04D 29/083; F04D 29/4206; F04D 29/4226; A47L 5/22; A47L 9/22; A47L 2201/00
See application file for complete search history.

(56) References Cited

U.S. PATENT DOCUMENTS

| | | | | |
|---|---|---|---|---|
| 7,651,325 | B1 * | 1/2010 | Esch | A47L 5/22 310/239 |
| 8,317,496 | B2 * | 11/2012 | Finkenbinder | F04B 17/00 415/199.3 |
| 2004/0047730 | A1 * | 3/2004 | Lee | F04D 25/06 415/220 |
| 2016/0290359 | A1 * | 10/2016 | Lee | F04D 25/06 |

FOREIGN PATENT DOCUMENTS

| | | | | | |
|---|---|---|---|---|---|
| CN | 206753946 | U | | 12/2017 | |
| GB | 130157 | A | * | 7/1919 | F04D 17/168 |
| JP | 2015213415 | A | | 11/2015 | |
| JP | 2016153636 | A | | 8/2016 | |

* cited by examiner

FAN ASSEMBLY FOR ROBOT VACUUM CLEANER AND ROBOT VACUUM CLEANER

CROSS-REFERENCE TO RELATED APPLICATION

This application is a continuation of International Application No. PCT/CN2018/098020, filed on Aug. 1, 2018, which claims priority to Chinese Patent Application Serial No. 201820837853.4, filed with the State Intellectual Property Office of P. R. China on May 30, 2018, the entire content of which is incorporated herein by reference.

FIELD

The present disclosure relates to vacuum cleaners and their accessories, and more particularly to a fan assembly for a robot vacuum cleaner and a robot vacuum cleaner.

BACKGROUND

With the diversification of the cleaning manners, a robot vacuum cleaner appears in more and more families. The operation manner of the robot vacuum cleaner is mainly divided into "suction" and "sweep". Similar to a traditional vacuum cleaner, the "suction" of the robot vacuum cleaner cannot do without a fan, and a structure of the fan is closely related to magnitude of a "suction force". Generally, the fan type applied in the robot vacuum cleaner includes an axial fan A as illustrated in FIG. 1. The axial fan A throws air to the periphery by an electric motor C that drives a rotor impeller B to rotate, thereby generating the suction force. The fan type in the robot vacuum cleaner also includes a centrifugal fan D as illustrated in FIG. 2. An air duct structure of the centrifugal fan D is similar to a volute, and the stator impeller is driven to rotate by the motor at a center of the centrifugal fan D, thereby generating the suction force. In the above fans, the air duct is mainly formed and defined by a housing of the fan, and the air duct has a poor air outlet guiding performance, this results in a relatively small suction force of the fan, such that the robot vacuum cleaner has a poor cleaning effect and a low efficiency.

SUMMARY

To address the above-described technical problem, embodiments of the present disclosure provide a fan assembly for a robot vacuum cleaner and a robot vacuum cleaner.

To this end, a technical solution of the present application is implemented such that:

Embodiments of the present disclosure provide a fan assembly for a robot vacuum cleaner. The fan assembly includes an electric motor, a stator impeller, a rotor impeller and a fan cover. The stator impeller has a shaft hole, the electric motor is mounted on a side of the stator impeller, and an output shaft of the electric motor passes through the shaft hole. The fan cover is mounted on another side of the stator impeller, and an end surface of the fan cover away from the stator impeller defines an air inlet. The rotor impeller is mounted to the output shaft of the electric motor and located between the fan cover and the stator impeller.

In the above-described solution, the fan cover has a cylindrical shape matching the rotor impeller, the air inlet is circular, and a ratio of a diameter of the air inlet to a diameter of the fan cover or the rotor impeller ranges from 1/5 to 4/5.

In the above-described solution, the ratio of the diameter of the air inlet to the diameter of the fan cover is 2/5.

In the above-described solution, the stator impeller includes a front impeller disc, a rear impeller disc and a plurality of blades;

the front impeller disc includes a round plate and a ring rim, the ring rim is disposed around a circumferential edge of the round plate and extends towards the electric motor, and the shaft hole is located in a center of the round plate;

the rear impeller disc includes a bottom plate and a first protruding rim, the bottom plate defines a first round hole at a middle thereof, the first protruding rim is disposed on the bottom plate along a circumferential edge of the first round hole and extends towards the fan cover; and the plurality of blades is fixed between the ring rim and the first protruding rim and spaced from one another, and gaps among the plurality of blades form a plurality of air-guiding passages.

In the above-described solution, the fan assembly further includes a first fastener, the electric motor has a first mounting hole, the round plate has a second mounting hole corresponding to the first mounting hole, and the first fastener passes through the first mounting hole and the second mounting hole to fasten the electric motor to the side of the stator impeller.

In the above-described solution, the fan cover is fitted over an outside of the first protruding rim, and the fan cover is in interference fit with the first protruding rim.

In the above-described solution, the fan assembly further includes a support seat and a second fastener, the stator impeller is mounted on the support seat;

the support seat includes a base plate and a first leg, the base plate defines a second round hole at a middle thereof, the base plate is provided with the first leg at two ends of the second round hole along the radial direction of the second round hole respectively; and the rear impeller disc further includes a second leg provided at two ends of the first round hole along a radial direction of the first round hole respectively, the second fastener passes through the first leg and the second leg to fasten the stator impeller to the support seat.

In the above-described solution, the first leg is provided with a bump, the second leg defines a groove matching the bump, and the bump extends into the groove.

In the above-described solution, the rear impeller disc further includes a second protruding rim, the second protruding rim is disposed on the bottom plate along the circumferential edge of the first round hole and extends towards the electric motor; and the base plate defines an annular groove matching the second protruding rim along a circumferential edge of the second round hole, and the second protruding rim is snapped into the annular groove.

Embodiments of the present disclosure further provide a robot vacuum cleaner, and the robot vacuum cleaner includes the above-described fan assembly for the robot vacuum cleaner.

Embodiments of the present disclosure provide the fan assembly for the robot vacuum cleaner and the robot vacuum cleaner, the electric motor is used to provide power to enable the output shaft of the electric motor to drive the rotor impeller to rotate, such that the air entering the fan cover from the air inlet is thrown to a periphery of the rotor impeller to generate a suction force. The air flow thrown to the periphery of the rotor impeller flows to an outlet along the gaps among the blades of the stator impeller. The stator impeller can effectively guide the air flow to make the fan has a more smooth air outlet and a prominent airflow direction, thereby improving the suction force and the dust suction effect of the fan.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

Figure 1:
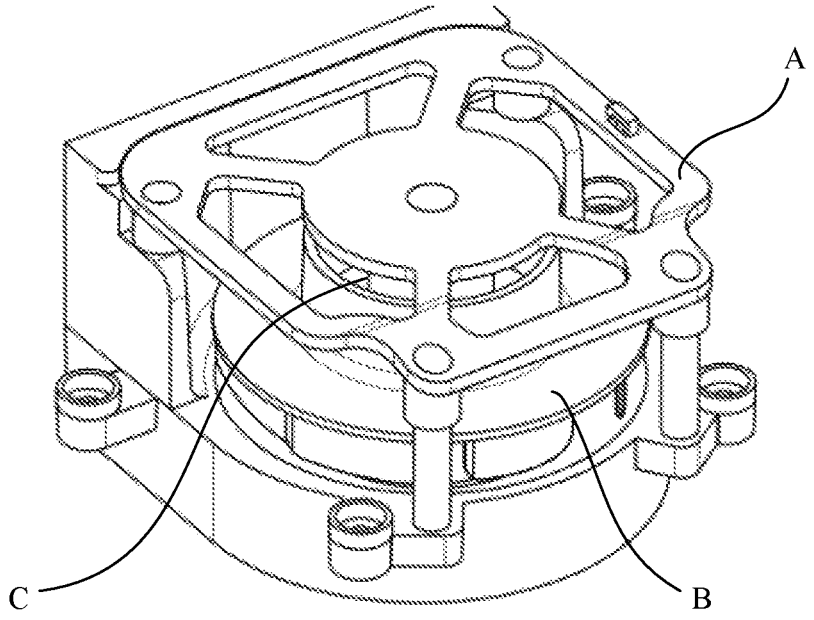
FIG. 1 is a schematic view of an axial fan in the related art.
Figure 2:
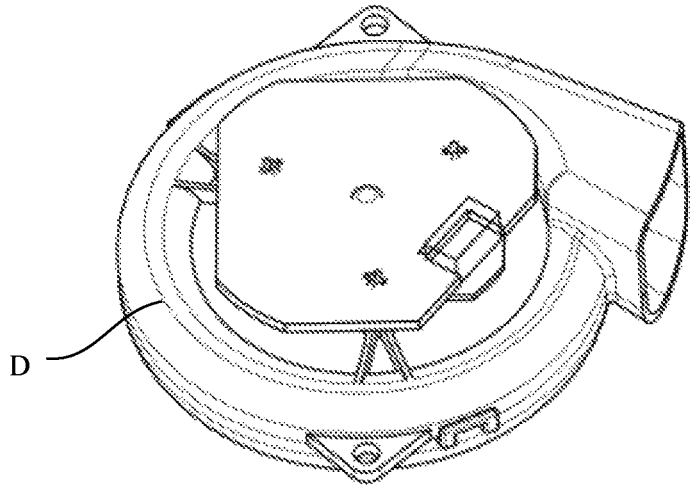
FIG. 2 is a schematic view of a centrifugal fan in the related art.

REFERENCE NUMERALS electric motor 10; output shaft 11; first mounting hole 12; stator impeller 20; round plate 21; blade 22; bottom plate 23; second leg 24; shaft hole 25; second mounting hole 26; first protruding rim 27; second protruding rim 201; first round hole 28; ring rim 29; rotor impeller 30; fan cover 40; air inlet 41; support seat 50; base plate 51; first leg 52; bump 53; second round hole 54; annular groove 55; wire-running notch 60.

DETAILED DESCRIPTION

In order to make objects, technical solutions and advantages of the embodiments of the present disclosure more clear, the technical solutions of embodiments of the present disclosure will be clearly and completely described below with reference to the accompanying drawings of the embodiments of the present disclosure. Obviously, the embodiments described herein are a part but not all of the embodiments of the present application. Based on the described embodiments of the present disclosure, all other embodiments obtained by those skilled in the art fall into the protection scope of the present application.

In the specification, it is to be understood that terms such as "upper," "lower," "inner," and "outer" should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

Figure 3:
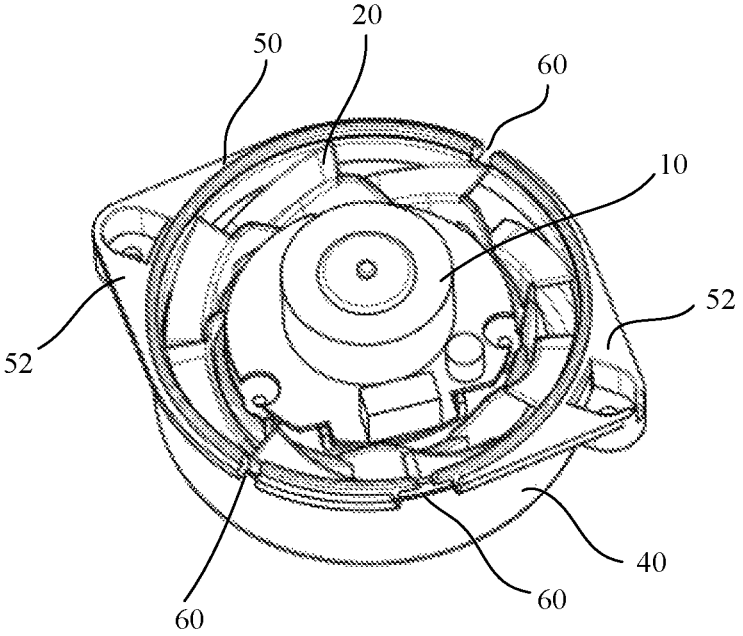
FIG. 3 is a schematic view of an alternative structure of a fan assembly for a robot vacuum cleaner according to an embodiment of the present disclosure.
Figure 4:
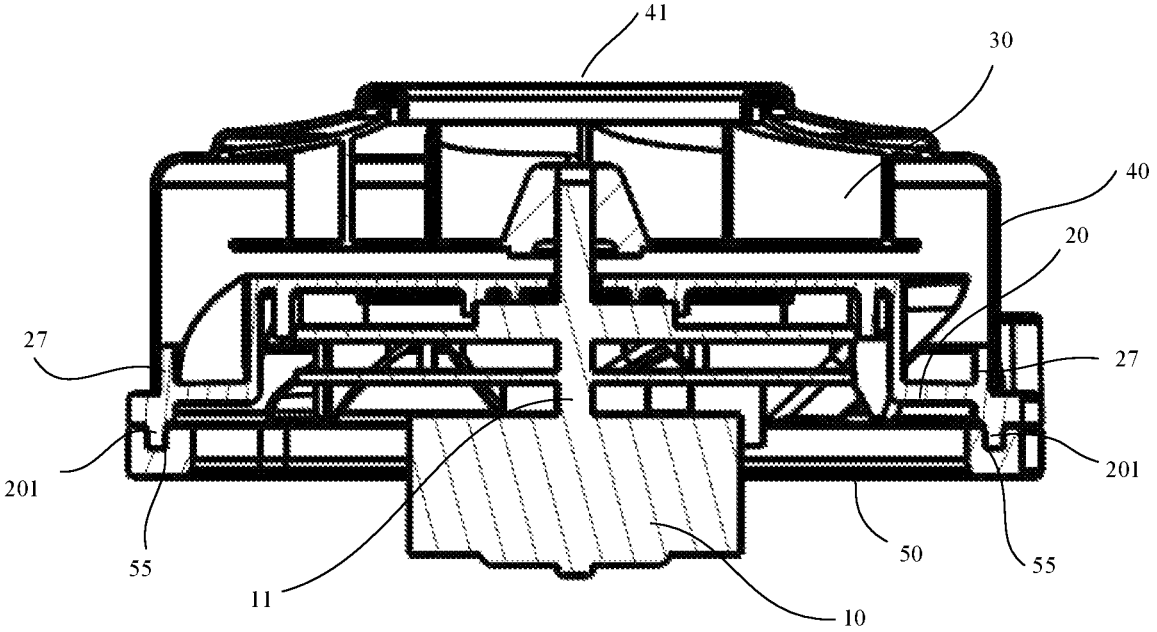
FIG. 4 is a sectional view of an alternative structure of a fan assembly for a robot vacuum cleaner according to an embodiment of the present disclosure.
Figure 5:
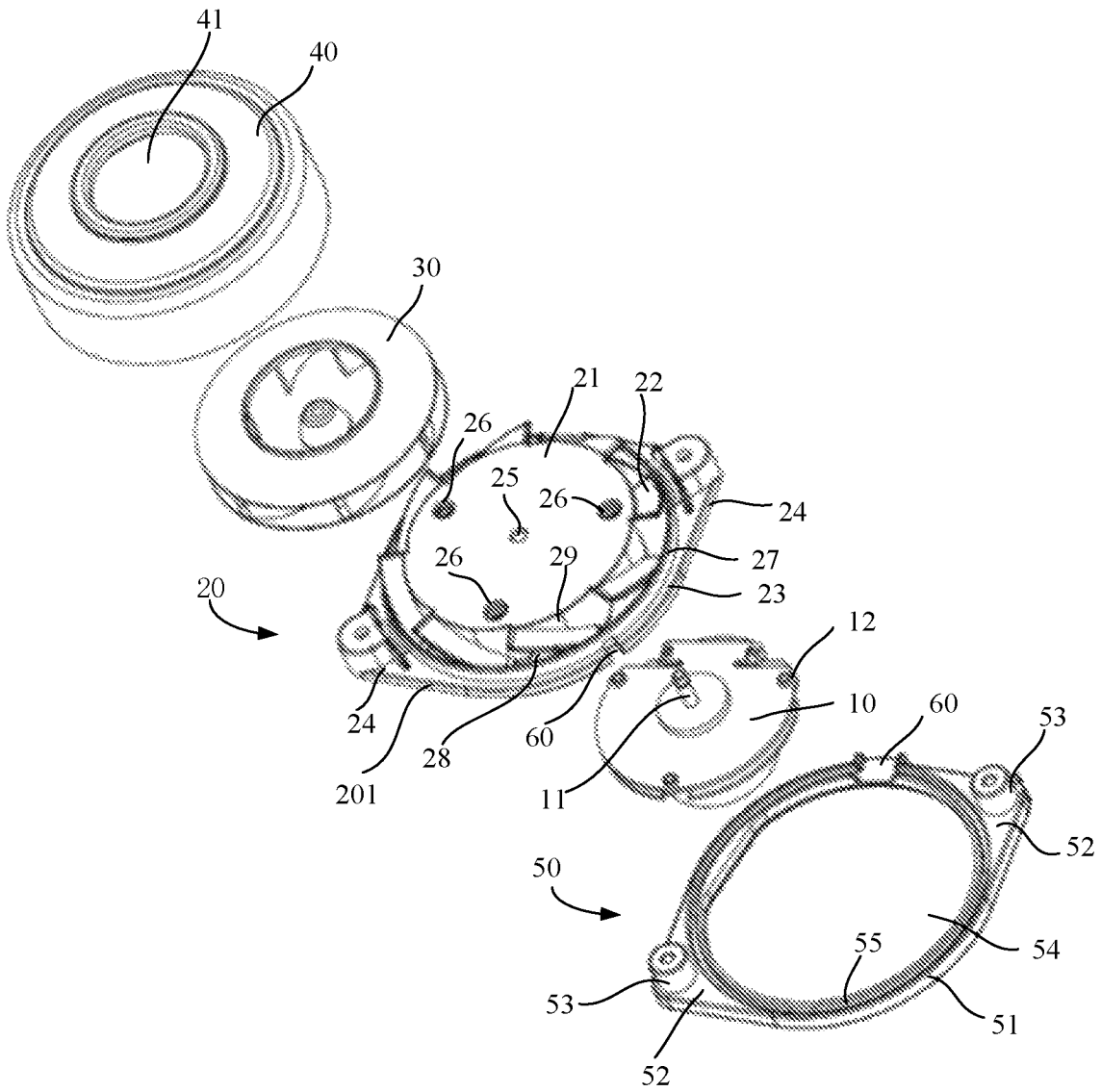
FIG. 5 is an exploded view of an alternative structure of a fan assembly for a robot vacuum cleaner according to an embodiment of the present disclosure.

Embodiments can provide a fan assembly for a robot vacuum cleaner, as illustrated in FIGS. 3 to 5. The fan assembly for the robot vacuum cleaner of the embodiment of the present disclosure includes an electric motor 10, a stator impeller 20, a rotor impeller 30 and a fan cover 40. The stator impeller 20 defines a shaft hole 25, the electric motor 10 is mounted on a side of the stator impeller 20, and an output shaft 11 of the electric motor 10 passes through the shaft hole 25. The fan cover 40 is mounted on another side of the stator impeller 20, and an end surface of the fan cover 40 away from the stator impeller 20 defines an air inlet 41. The rotor impeller 30 is mounted to the output shaft 11 of the electric motor 10 and located between the fan cover 40 and the stator impeller 20.

In the embodiment shown in FIGS. 3-5, the output shaft 11 of the electric motor 10 passes through the shaft hole 25 located in a center of the stator impeller 20 and is connected to a center of the rotor impeller 30 so as to drive the rotor impeller 30 to rotate. An outer diameter of the shaft hole 25 is greater than an outer diameter of the output shaft 11. An end surface of the fan cover 40 is mounted on the stator impeller 20 and another end surface thereof defines the air inlet 41. The rotor impeller 30 is disposed in the fan cover 40 and located between the air inlet 41 and the rotor impeller 30. Thus, a size of the fan cover 40 just needs to be slightly greater than that of the rotor impeller 30, and structure among respective components of the fan assembly is compact, which can effectively reduce a height of the fan assembly, thereby better meet small height requirement of the robot vacuum cleaner. The stator impeller 20 guides the air flow entering the fan assembly, which effectively promotes vacuum degree and suction force of the fan assembly.

In an alternative implementation, the fan cover 40 can have a cylindrical shape matching the rotor impeller 30, the air inlet 41 is circular, and a ratio of a diameter of the air inlet 41 to a diameter of the fan cover 40 or the rotor impeller 30 ranges from 1/5 to 4/5. Further, the ratio of the diameter of the air inlet 41 to the diameter of the fan cover 40 is 2/5.

At the same power level of the electric motor 10, when the ratio of the diameter of the air inlet 41 to the diameter of the fan cover 40 or rotor impeller 30 is 1/5 to 4/5, the suction force of the fan assembly is relatively large. FIG. 4 exemplarily shows a sectional view of an alternative structure of the fan assembly for the robot vacuum cleaner. The diameter of the air inlet in this example is 28 mm, the diameter of the fan cover 40 in this example is 69 mm, and the air inlet 41, the fan cover 40, the rotor impeller 30, the stator impeller 20 and the electric motor 10 all are coaxially disposed.

In another alternative implementation, the stator impeller 20 can include a front impeller disc, a rear impeller disc and a plurality of blades 22. The front impeller disc includes a round plate 21 and a ring rim 29, the ring rim 29 is disposed around a circumferential edge of the round plate 21 and extends towards the electric motor 10, and the shaft hole 25 is located in a center of the round plate 21. The rear impeller disc includes a bottom plate 23 and a first protruding rim 27, the bottom plate 23 defines a first round hole 28 at a middle thereof, and the first protruding rim 27 is disposed on the bottom plate 23 along a circumferential edge of the first round hole 28 and extends towards a direction of the fan cover 40. The plurality of blades 22 is fixed between the ring rim 29 and the first protruding rim 27 and spaced from one another, and gaps among the plurality of blades 22 form a plurality of air-guiding passages.

The airflow entering the fan assembly is discharged from the first round hole 28 under the guiding of the blades 22. The plurality of blades 22 are evenly disposed at intervals along an axis of the stator impeller 20, and the number of the blades 22 can be adjusted according to requirements. The stator impeller 20 is further provided with a plurality of wire-running notches 60 which facilitates the mounting and positioning of wire harness of the fan assembly. FIG. 5 exemplarily shows an exploded view of the fan assembly for the robot vacuum cleaner. The wire-running notch 60 of the stator impeller 20 is located on the bottom plate 23.

In an alternative implementation, the fan assembly for the robot vacuum cleaner further includes a first fastener (not illustrated), the electric motor 10 defines a first mounting hole 12, the round plate 21 defines a second mounting hole 26 corresponding to a first mounting hole 12, and the first fastener passes through the first mounting hole 12 and the second mounting hole 26 to fasten the electric motor 10 to the side of the stator impeller 20.

In order to ensure the stability of the connection between the stator impeller 20 and the electric motor 10, a plurality of first fasteners, a plurality of first mounting holes 12 and a plurality of second mounting holes 26 may be provided according to requirements. The first fastener includes but is not limited to a bolt and a screw. As illustrated in FIG. 5, the end surface of the electric motor 10 defines three first mounting holes 12 evenly spaced along the circumferential direction, the front impeller disc 21 defines three second mounting holes 26 along the circumferential direction corresponding to the first mounting holes 12, and the fastener passes through the first mounting hole 12 and the second mounting hole 26 to fix the stator impeller 20 to the electric motor 10.

In another alternative implementation, the fan cover 40 is fitted over an outside of the first protruding rim 27, and the fan cover 40 is in interference fit with the first protruding rim 27.

As illustrated in FIGS. 3 and 5, the fan cover 40 is fixed to the stator impeller 20 by the interference fit with the first protruding rim 27. The mounting manner is simple and easy.

In another alternative implementation, the fan assembly for the robot vacuum cleaner further includes a support seat 50 and a second fastener, and the stator impeller 20 is mounted on the support seat 50. The support seat 50 includes a base plate 51 and a first leg 52, the base plate 51 defines a second round hole 54 at a middle thereof, and the base plate 51 is provided with the first leg 52 at two ends of the second round hole 54 along a radial direction of the second round hole 54 respectively. The rear impeller disc further includes a second leg 24 disposed at two ends of the first round hole 28 along a radial direction of the first round hole 28, and the second fastener passes through the first leg 52 and the second leg 24 to fasten the stator impeller 20 to the support seat 50.

The support seat 50 can be made of a material with the noise and vibration reduction function. For example, the support seat 50 is a rubber member. As the stator impeller 20 is connected to the electric motor 10, when the electric motor 10 is in operation, the vibration will occur on the electric motor 10 itself or between the electric motor 10 and the stator impeller 20 to generate the noise. The support seat 50 can absorb acoustic wave and reduce the vibration and noise. In order to facilitate the positioning and mounting of wire harness of the fan assembly, the support seat 50 may also be provided with the wire-running notch 60 according to requirements. The second fastener includes but is not limited to the bolt and the screw. As illustrated in FIG. 3, three wire-running notches 60 are provided and spaced along a circumferential direction of the base plate 51, the electric motor 10 passes through the second round hole 54 and connect to the stator impeller 20, and the support seat 50 surrounds a periphery of the electric motor 10, thereby facilitating the improvement of the noise reduction effect.

In another alternative implementation, the first leg 52 is provided with a bump 53, the second leg 24 defines a groove matching the bump 53, and the bump 53 extends into the groove.

The initial assembly can be completed by extending the bump 53 into the groove, thereby facilitating the mounting and positioning. The second fastener improves the stability of the connection between the both. FIG. 5 exemplarily shows the exploded view of an alternative structure of the fan assembly for the robot vacuum cleaner. Each first leg 52 is provided with one bump 53, and the bump 53 protrudes towards the stator impeller 20.

In an alternative implementation, the rear impeller disc further includes a second protruding rim 201, and the second protruding rim 201 is disposed on the bottom plate 23 along the circumferential edge of the first round hole 28 and extends towards the direction of the electric motor 10. The base plate 51 defines an annular groove 55 matching the second protruding rim 201 along the circumferential edge of the second round hole 54, and the second protruding rim 201 is snapped into the annular groove 55.

The second protruding rim 201 is snapped into the annular groove 55, such that not only the fitting of the stator impeller 20 and the support seat 50 can be more compact, but also the sealing effect can be improved, effusion of the airflow within the fan assembly can be reduced, and the suction force of the fan assembly can be promoted.

The robot vacuum cleaner according to the present disclosure includes the fan assembly for the robot vacuum cleaner of the above embodiments. Since the fan assembly for the robot vacuum cleaner according to embodiments of the present disclosure has the above-described effect, the robot vacuum cleaner according to embodiments of the present disclosure also has the corresponding technical effect, i.e. the structure is compact. The stator impeller 20 can effectively guide the air flow to make the fan has a more smooth air outlet and a prominent airflow direction, thereby improving the suction force of the fan assembly and ground suction effect and ground suction efficiency of the robot vacuum cleaner.

Other structures and operations of the robot vacuum cleaner according to embodiments of the present disclosure are appreciable and readily achieved, which thus will not be described in detail herein.

The above-described are merely preferred embodiments of the present disclosure, which are not intended to limit the protection scope of the present disclosure.

What is claimed is:

1. A fan assembly for a robot vacuum cleaner, comprising an electric motor, a stator impeller, a rotor impeller and a fan cover; and wherein, the stator impeller has a shaft hole, the electric motor being mounted on a first side of the stator impeller, and an output shaft of the electric motor passing through the shaft hole;

the fan cover is mounted on a second side of the stator impeller, an end surface of the fan cover defining an air inlet, the end surface being a surface of the fan cover away from the stator impeller; and the rotor impeller is mounted to the output shaft of the electric motor and located between the fan cover and the stator impeller;

wherein the stator impeller comprises a front impeller disc, the front impeller disc comprising a round plate and a ring rim, the ring rim being disposed around a circumferential edge of the round plate and extending towards the electric motor; and, wherein the shaft hole is located in a center of the round plate;

the stator impeller further comprises a rear impeller disc, wherein the rear impeller disc comprises a bottom plate and a first protruding rim, the bottom plate defining a first round hole at a middle thereof, the first protruding rim being disposed on the bottom plate along a circumferential edge of the first round hole and extending towards the fan cover;

wherein the stator impeller further comprises a plurality of blades provided on upper surface of the rear impeller disc facing towards the rotor impeller and spaced from one another, the plurality of blades is fixed between the ring rim and the first protruding rim;

wherein the fan assembly further comprising a first fastener, the electric motor has a first mounting hole, the round plate has a second mounting hole corresponding to the first mounting hole, and the first fastener passes through the first mounting hole and the second mounting hole to fasten the electric motor to the side of the stator impeller.

2. The fan assembly according to claim 1, wherein the fan cover has a shape matching the rotor impeller, the air inlet is circular, and a ratio of a diameter of the air inlet to a diameter of the fan cover or the rotor impeller ranges from 1/5 to 4/5.

3. The fan assembly according to claim 2, wherein the ratio of the diameter of the air inlet to the diameter of the fan cover is 2/5.

4. The fan assembly according to claim 2, wherein the fan cover has a cylindrical shape.

5. The fan assembly according to claim 1, wherein the fan cover is fitted over an outside of the first protruding rim, and the fan cover is in interference fit with the first protruding rim.

6. The fan assembly according to claim 1, further comprising a support seat and a second fastener, the stator impeller being mounted on the support seat, wherein the support seat comprises a base plate and a first leg, the base plate defining a second round hole at a middle thereof, and the base plate being provided with the first legs at two ends of the second round hole along a radial direction of the second round hole respectively; and the rear impeller disc further comprising two second legs provided at two ends of the first round hole along a radial direction of the first round hole respectively, the second fastener passing through the first leg and the second leg to fasten the stator impeller to the support seat.

7. The fan assembly according to claim 6, wherein the first leg is provided with a bump, the second leg defines a groove matching the bump, and the bump extends into the groove.

8. The fan assembly according to claim 6, wherein the rear impeller disc further comprises a second protruding rim, the second protruding rim is disposed on the bottom plate along the circumferential edge of the first round hole and extends towards the electric motor; and the base plate defines an annular groove matching the second protruding rim along a circumferential edge of the second round hole, and the second protruding rim is snapped into the annular groove.

9. A robot vacuum cleaner, comprising a fan assembly for a robot vacuum cleaner, the fan assembly comprising an electric motor, a stator impeller, a rotor impeller and a fan cover; and wherein, the stator impeller has a shaft hole, the electric motor being mounted on a first side of the stator impeller, and an output shaft of the electric motor passing through the shaft hole;

the fan cover is mounted on a second side of the stator impeller, an end surface of the fan cover defining an air inlet, the end surface being a surface of the fan cover away from the stator impeller; and the rotor impeller is mounted to the output shaft of the electric motor and located between the fan cover and the stator impeller;

wherein the stator impeller comprises a front impeller disc, the front impeller disc comprising a round plate and a ring rim, the ring rim being disposed around a circumferential edge of the round plate and extending towards the electric motor; and, wherein the shaft hole is located in a center of the round plate;

the stator impeller further comprises a rear impeller disc, wherein the rear impeller disc comprises a bottom plate and a first protruding rim, the bottom plate defining a first round hole at a middle thereof, the first protruding rim being disposed on the bottom plate along a circumferential edge of the first round hole and extending towards the fan cover;

wherein the stator impeller further comprises a plurality of blades provided on upper surface of the rear impeller disc facing towards the rotor impeller and spaced from one another, the plurality of blades is fixed between the ring rim and the first protruding rim;

wherein the robot vacuum cleaner further comprising a first fastener, the electric motor has a first mounting hole, the round plate has a second mounting hole corresponding to the first mounting hole, and the first fastener passes through the first mounting hole and the second mounting hole to fasten the electric motor to the side of the stator impeller.

10. The robot vacuum cleaner according to claim 9, wherein the fan cover has a shape matching the rotor impeller, the air inlet is circular, and a ratio of a diameter of the air inlet to a diameter of the fan cover or the rotor impeller ranges from 1/5 to 4/5.

11. The robot vacuum cleaner according to claim 10, wherein the ratio of the diameter of the air inlet to the diameter of the fan cover is 2/5.

12. The robot vacuum cleaner according to claim 9, wherein the fan cover is fitted over an outside of the first protruding rim, and the fan cover is in interference fit with the first protruding rim.

13. The robot vacuum cleaner according to claim 9, further comprising a support seat and a second fastener, the stator impeller being mounted on the support seat, wherein the support seat comprises a base plate and a first leg, the base plate defining a second round hole at a middle thereof, and the base plate being provided with the first legs at two ends of the second round hole along a radial direction of the second round hole respectively; and the rear impeller disc further comprising two second legs provided at two ends of the first round hole along a radial direction of the first round hole respectively, the second fastener passing through the first leg and the second leg to fasten the stator impeller to the support seat.

14. The robot vacuum cleaner according to claim 13, wherein the first leg is provided with a bump, the second leg defines a groove matching the bump, and the bump extends into the groove.

* * * * *